United States Patent [19]

Whiteledge

[11] Patent Number: 4,768,697

[45] Date of Patent: Sep. 6, 1988

[54] FASTENER DRIVER AND MAGAZINE THEREFOR

[75] Inventor: Jon K. Whiteledge, Ravenna, Ohio

[73] Assignee: Erico International Corporation, Solon, Ohio

[21] Appl. No.: 919,983

[22] Filed: Oct. 17, 1986

[51] Int. Cl.[4] ..... B25C 1/04; B25C 7/00

[52] U.S. Cl. ..... 227/120; 227/126; 227/130

[58] Field of Search ..... 227/120, 125, 126, 130, 227/156

[56] References Cited

U.S. PATENT DOCUMENTS

| | | | |
|---|---|---|---|
| 3,266,698 | 8/1966 | Dickson | 227/120 |
| 3,786,980 | 1/1974 | Passer | 227/120 |
| 3,863,824 | 2/1975 | Bakoledis | 227/126 X |
| 3,945,550 | 3/1976 | Monacelli | 227/126 |
| 4,312,472 | 1/1982 | Okuda | 227/120 X |
| 4,323,184 | 4/1982 | Maurer | 227/126 |
| 4,463,888 | 8/1984 | Geist et al. | 227/125 X |

*Primary Examiner*—Paul A. Bell

*Attorney, Agent, or Firm*—Renner, Otto, Boisselle & Sklar

[57] ABSTRACT

A power operated fastening tool which includes a power actuated driver rod and a notched safety and valve slide also includes a simplified circular magazine to feed fasteners one at a time beneath the driver rod. The circular magazine includes a small diameter circular track for holding a plastic collation strip with the fasteners supported by the collation strip in such track. The magazine includes a coil spring loaded handle on top of the magazine which forces the collation strip and thus the fasteners into position beneath the driver rod for driving one at a time by the driver rod of the power actuated tool. The magazine handle on top and projecting radially feeds the fasteners to proper striking position beneath the driver rod without indexing by the slide. The handle is pivoted and latched clear of the entry end of the magazine for feeding a collation strip into the magazine track. The handle is then repositioned on the track. In this manner a simple, more compact and efficient power operated fastening tool is provided.

21 Claims, 3 Drawing Sheets

FASTENER DRIVER AND MAGAZINE THEREFOR

BACKGROUND OF THE INVENTION

Power operated tools such as shown for example in U.S. Pat. No. 3,893,610, normally incorporate a linear magazine which feeds nails or other type fasteners one at a time to a nail slide which then indexes the fastener to a position beneath the power actuated driver rod. Such magazines may be gravity or spring fed and normally project laterally a substantial distance from the lower end of the tool. In such magazines, it is also common to collate the fasteners by a strip of adhesive tape on one or both sides of the shank of the fastener. In such magazines jam ups are not uncommon both in the magazine and at the nail slide. Such tape collations are also unwieldly and require too many hands to load.

Because of the lateral projection of the magazine for the tool, the tool is in some instances quite unwieldly. The operator may actually have to step back from the tool or step over the magazine to obtain proper tool position. Also, in tight corners, such as in the nailing of studs, the tool may be difficult to position properly. Thus a more efficient and more compact magazine is to be highly desired.

Some attempts have been made to provide circular or more compact feed magazines in power actuated tools, one example being seen in U.S. Pat. No. 3,863,824. Such magazines are normally fairly complex and expensive, as well as difficult to operate. For example, the noted patent illustrates a magazine having a complexity of parts including a special cam track through which a follower moves. The spring loaded follower is actuated by a follower member which is on the bottom of the magazine. Such follower member must be depressed upwardly to release the follower which then presses the strip of fasteners directly into the tool muzzle. Moreover, the tool does not incorporate a safety slide into which the fastener is first fed. This means the operator most conveniently may load the tool with it upside down or pointing directly at the user, particularly when employing long shank fasteners which may project considerably below the magazine. To do otherwise would be like reaching into a cactus patch from the bottom.

Accordingly there is a need in larger power operated tools such as nail drivers for a compact and simplified magazine which can quickly, conveniently, and safely be loaded.

SUMMARY OF THE INVENTION

This invention relates to a power operated fastening tool which includes a power actuated driver rod and a fastener slide also including a circular magazine to feed fasteners one at a time beneath the driver rod. The circular magazine includes a small diameter circular track for holding a plastic collation strip of fasteners supported by the collation strip in such track. The magazine includes a coil spring loaded handle on top of the magazine which forces the collation strip and thus the fasteners into position beneath the driver rod for driving one at a time by the driver rod of the power actuated tool. The magazine handle on top and projecting radially feeds the fasteners to proper striking position beneath the driver rod without indexing by the fastener slide. The handle is pivoted and latched clear of the entry end of the magazine for feeding a collation strip into the magazine track. The handle is then repositioned on the track. In this manner a simplified, more compact and efficient power operated fastening tool is provided.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
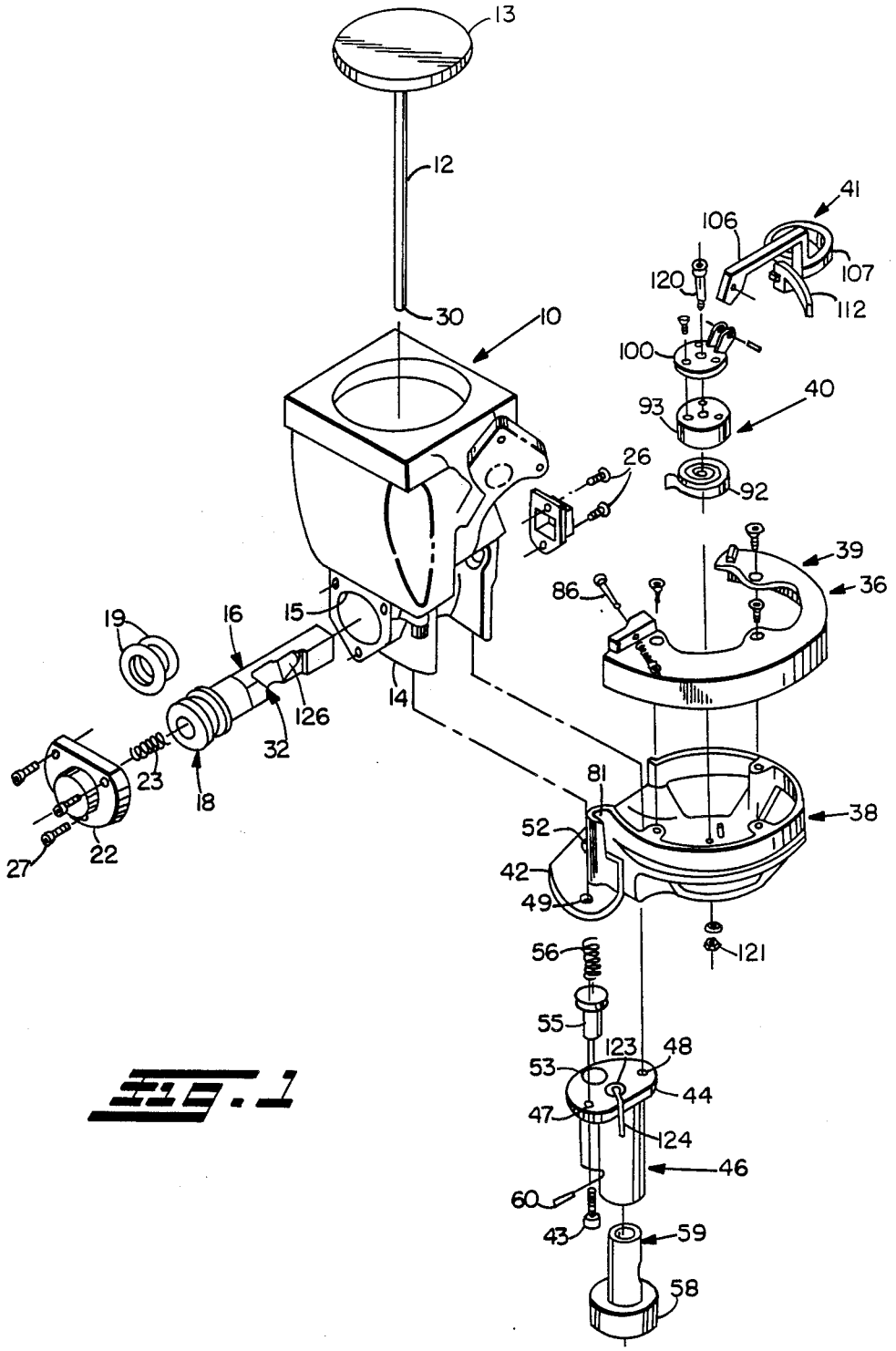
FIG. 1 is an exploded view showing portions of the tool and the magazine.

Referring first to FIG. 1 there is illustrated in exploded form a portion of the fastener driver as well as the magazine therefor. The magazine is illustrated in the upper righthand portion of such figure. The fastener driver includes a lower housing portion 10, which cooperates with an upper housing portion, not shown, in which is situated a fastener driver or ram 12 actuated pneumatically by piston 13. For a more detailed illustration of the type of power tool reference may be had to the aforenoted U.S. Pat. No. 3,893,610.

Fastened to the bottom of the lower housing is a nose support 14 which is provided with a horizontal or transversely extending passage 15 in which is situated a shuttle or slide 16. One end of the shuttle forms a piston as seen at 18 which is provided with O rings 19. One end of the passage 15 is provided with a shuttle end plate 22 with a compression spring 23 extending between the end plate and the shuttle.

The shuttle for the most part is square or rectangular in sectional configuration and the opposite end of the passage is provided with a shuttle guide cover seen at 25 held in place by fasteners 26. The shuttle end plate is similarly secured by fasteners 27.

The shutter 16 serves several purposes. One is to provide a safety or physical block to the lower end 30 of the ram. When the shuttle is in one position the ram is physically blocked from extending or firing. Another purpose is to provide part of the sequence valving which prepares the tool for firing. The tool cannot be fired until the shuttle has shifted to align the notch or recess indicated at 32 with the axis of the driver or ram 12. When in such proper position, the notch then also serves to receive the initial or next fastener in a collation of fasteners from the magazine shown generally at 36. In addition, the shuttle cooperates with the magazine to render the shuttle and thus the tool inoperative when the magazine is empty.

As illustrated, the magazine includes a base 38, a cover 39, a center spring assembly 40 and a handle 41.

The base of the magazine includes a flange indicated generally at 42 which fastens on the underside of the nose support 14 by means of fasteners 43 which also extend through the top flange 44 of nose body 46. The two holes seen at 47 and 48 in the flange 44 align with the holes 49 and 50, in the flange 42, respectively. The flanges 42 and 44 also include somewhat larger aligned apertures seen at 52 and 53, respectively, which receive touch probe 55 which is loaded downwardly by spring 56. The touch probe engages the top of the enlarged portion 58 of the vertically movable centering devide 59. A split pin 60 retains the shank of the centering device within the nose body while also limiting its vertical movement.

Figure 2:
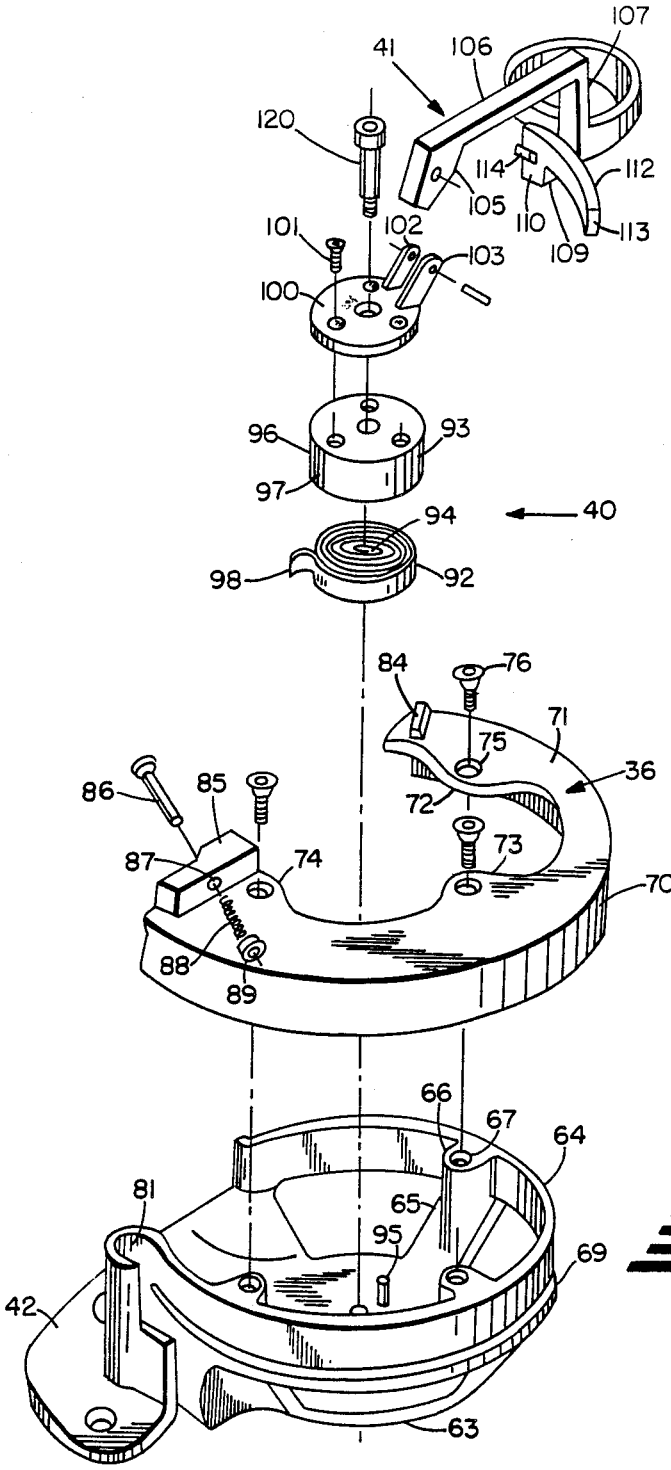
FIG. 2 is an enlarged exploded view of the magazine only.
Figure 3:
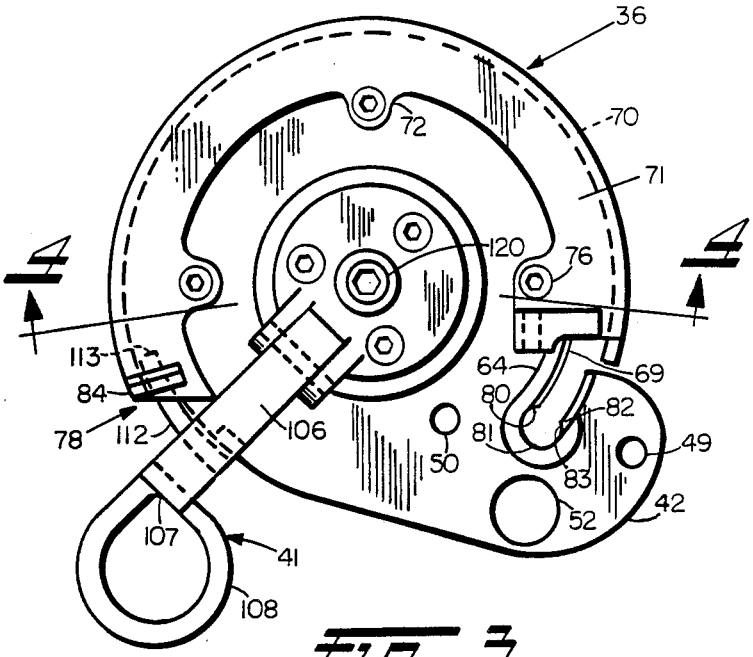
FIG. 3 is an enlarged top plan view of the magazine.
Figure 4:
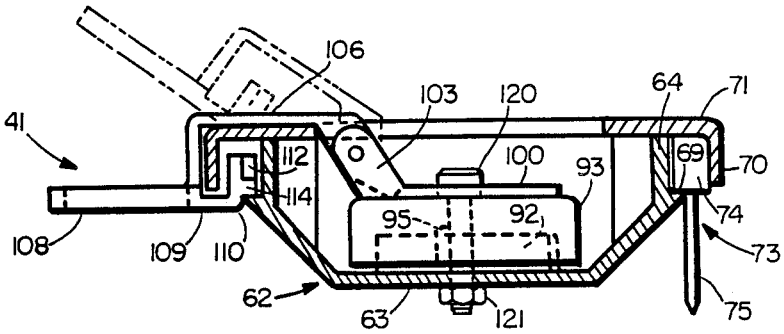
FIG. 4 is a vertical section taken on the line 4—4 of FIG. 3.

Referring now additionally to FIGS. 2, 3 and 4 it will be seen that the base 38 of the magazine includes a lower generally shallow cup-shape portion 62 which includes a flat generally circular bottom wall 63.

The upper portion of the base comprises a generally annular vertical wall 64 which is supported from the bottom wall by upwardly outwardly inclined legs 65 which on the upper sides thereof include inwardly directed bosses 66 provided with tapped holes 67. The exterior of the lower edge of the wall 64 is provided with a slight shelf indicated at 69.

The cover 36 is generally circular and includes a circular outer depending skirt or wall 70 and an inwardly extending top wall 71 with the inner edge of such wall including inwardly projecting radiused portions seen at 72, 73 and 74, each provided with beveled apertures 75 through which recessed head fasteners 76 extend so that the cover may be secured to the base as indicated more clearly in FIG. 2.

As seen in FIG. 4, the outer wall 70 of the cover together with the top wall 71 cooperates with the wall 64 of the base and the shelf 69 to form a circular track for the collation of fasteners indicated generally at 73. The collation of fasteners comprises a plastic strip of interconnected cylindrical housings 74 in which the head of the fastener or nail is positioned or supported while the shank of the fastener indicated at 75 projects from the bottom.

As seen more clearly in FIG. 3, the outer or cover wall 70 extends for approximately 240° providing an open or feed end for the track thus formed seen at 78. At the opposite or discharge end, the shelf 69 extends beyond the cover and terminates in the circular edge as indicated at 80 in FIG. 3. The wall 64 of the base continues to form a circular recess seen at 81 which is in vertical alignment with the notch 32 in the shuttle 16 when the latter is in firing position. The opposite side of the wall 64 may be notched as indicated at 82 to form a shelf and the terminal edge 83 of such shelf is a continuation of the circular recess 81 as is the edge 80.

The top wall of the cover is provided with a catch or latch block seen at 84 in FIG. 3 at the entry or feed end while at the exit or opposite end, the top wall is provided with a block 85 which houses headed pin 86 (see FIG. 2). The pin projects through the aperture 87 in such block and is surrounded by a compression spring 88 which extends between the block and collar 89 secured to the end of the pin. The compression spring urges the pin to its retracted position or downwardly as indicated in FIG. 2.

The center of the magazine is provided with the spring assembly 40 which includes the convolute spring 92 and spring cover 93. The convolute spring at its inner end is hooked as seen at 94, such hook extending around pin 95 projecting upwardly from the bottom wall 63 of the base. The cover includes an annular skirt 96 surrounding the spring, such skirt being provided with a vertical slot 97 on its lower edge which captures the opposite or projecting end 98 of the spring.

Secured to the top of the cover 93 is a handle base 100 by suitable fasteners 101. The handle base includes an annular plate with two upstanding inclined parallel ears 102 and 103 which form a clevis connection for the proximal enlarged end 105 of operating handle 41. The enlargement 105 of the proximal end is configured to fill substantially the space between the ears 102 and 103 to facilitate the torque transmission between the handle base and the handle arm 106. The outer or distal end of the arm 106 extends downwardly and forms vertical leg 107 with the arm and leg closely conforming to the top and skirt 71 and 70, respectively, of the magazine cover.

Projecting radially outwardly from the lower end of the leg 107 is a ring finger grip 108. Extending inwardly from the ring finger grip is a relatively short horizontal leg 109 which then extends upwardly as indicated at 110. Extending horizontally and circularly from the upstanding or upwardly directed portion 110 is a pusher arm 112, the tip 113 of which is designed to engage behind the plastic collation of fasteners inserted into the track formed between the base and cover. The upstanding portion 110 also includes an inwardly projecting tab 114 designed to rest upon the shelf 69 of the track.

In order to load the magazine, the operator simply moves the handle 41 in a counterclockwise direction as viewed in FIG. 3 against the pressure of the spring 92 until the pusher arm clears the entry end of the track as seen in FIG. 3. At that point the heel of the horizontal leg 109 below the pusher arm may be positioned against the stop 84. The feed end of the track is then clear for insertion of the next collation of fasteners. The handle is then repositioned to place the pusher 112 into the track and released.

The entire magazine assembly is held together by means of the center shoulder bolt 120 held in place by nut 121. In this manner the magazine is rather easily assembled and disassembled and the entire magazine may be secured by the fasteners 43 to the bottom of the nose support 24 with the circular recess 81 in the end of the track in alignment with the driver 12 and the vertical hole 123 through the nose body 46. As seen in FIG. 1 the nose body is provided with a vertical slot 124 through which the shank of larger fasteners pass to be positioned beneath the ram.

When the handle arm 106 reaches a position where the last fastener of the collation strip has been expended, such arm engages the collar 89 on the end of pin 86 pushing the pin against the pressure of spring 88 causing its headed tip to enter locking pin cavity 126 in the shuttle 16 precluding it from movement to firing position. The tool will remain inoperative until the handle is removed during the collation strip reloading operation, all of which can be accomplished from the top of the magazine. For an illustration of the type of collation strip which may preferably be used with the present invention, reference may be had to applicant's copending application for U.S. Letters Patent entitled "Collation Strip", filed even date herewith.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

I claim:

1. A power tool for driving fasteners comprising a power operated ram, a circular magazine for feeding fasteners one at a time to a position beneath said ram, said magazine comprising a base and a cover, said base and cover cooperating to form a circular track having an open feed end, a handle on top of said magazine including a pusher adapted to fit within said track, spring means for rotating said handle and pusher about the axis of said magazine to feed fasteners along said track, and means for pivotally mounting said handle for movement about a pivot axis transverse to that of said magazine whereby when said pusher is rotated to a position clear of the open end of said track, said track may be cleared by pivoting said handle about said pivot axis so that a collation of fasteners may be fed into such open end.

2. A tool as set forth in claim 1 wherein said track is formed by the top wall and outer skirt of the cover, and a wall and outwardly directed shelf of the base.

3. A tool as set forth in claim 2 wherein said handle extends radially over the top of the cover, then downwardly along said outer skirt, then inwardly beneath said skirt, and then upwardly, said pusher extending circularly from the upper end of said last mentioned portion of the handle.

4. A tool as set forth in claim 3 including an inwardly directed tab on said pusher adapted to ride on said shelf.

5. A tool as set forth in claim 1 including means to hold said handle and said pusher clear of said feed end.

6. A power tool for driving fasteners comprising a power driven reciprocating ram, a shuttle movable transversely of the path of the ram, a magazine for feeding fasteners one at a time beneath said shuttle and in alignment with said ram comprising a circular track having an axis parallel to but offset from the path of the ram adapted to receive a collation of said fasteners, a spring in the center of said circular track, a pusher connected to said spring operative to push said collation along said track operative to feed fasteners one at a time to such position beneath said shuttle, said magazine comprising a base and an open cover, said spring being mounted on said base, a handle connected to said spring and extending radially over the top of said cover.

7. A tool as set forth in claim 6 wherein said shuttle is movable transversely of the path of the ram between a blocking position in which said shuttle blocks movement of said ram and an operating position in which said ram is free to move and including means responsive to the feeding of the final fastener in said magazine to lock said shuttle against movement in said blocking position.

8. A tool as set forth in claim 7 wherein said last mentioned means comprises a spring loaded pin on said magazine engaged by said handle after the last fastener in said magazine has been expended.

9. A tool as set forth in claim 6 wherein said track is formed by the top wall and outer skirt of the cover, and a wall and outwardly directed shelf of the base.

10. A tool as set forth in claim 9 wherein said handle extends radially over the top of the cover, then downwardly along said outer skirt, then inwardly beneath said skirt, and then upwardly, said pusher extending circularly from the upper end of said last mentioned portion of the handle.

11. A power tool for driving fasteners and the like comprising a power operated ram, a circular magazine for feeding fasteners one at a time to a position beneath said ram, said magazine having an axis parallel to but offset from the axis of the ram and comprising a base and cover, the former being mounted on said tool, said base and cover cooperating to form a circular track having an open feed end, and a spring loaded handle projecting radially beyond said magazine, said handle including a pusher operative to urge a collation of said fasteners along said track toward said position beneath said ram, a spring assembly in the center of said magazine, said handle extending from said spring assembly radially over the top of said cover, and means for pivoting the handle about an axis transverse to that of the axis of the magazine between a first position in which the handle and pusher are clear of said feed end of said track to enable a collation of fasteners to be inserted into the feed end of the track and a second position in which the pusher is aligned with the track to push a collation of fasteners around the track.

12. A tool as set forth in claim 11 including means to hold the handle and thus the pusher in such clear position.

13. A tool as set forth in claim 12 wherein said last mentioned means comprises a stop on the cover adjacent the feed end.

14. A power tool for driving fasteners comprising a power operated ram, a circular magazine for feeding fasteners one at a time to a position beneath said ram, said magazine having an axis parallel to but offset from the axis of the ram and comprising a base and cover, the former being mounted on said tool, said base and cover cooperating to form a circular track having an open feed end, and a spring loaded handle projecting radially beyond said magazine, said handle including a pusher operative to urge a collation of said fasteners along said track toward said position beneath said ram, a spring assembly in the center of said magazine, said handle extending from said spring assembly radially over the top of said cover, a shuttle movable beneath said ram, and means responsive to the feeding of the final fastener in said magazine to lock said shuttle against movement.

15. A tool as set forth in claim 14 wherein said last mentioned means comprises a spring loaded pin on said magazine engaged by said handle after the last fastener in said magazine has been expended.

16. A power tool for driving fasteners comprising a power operated ram, a circular magazine for feeding fasteners one at a time to a position beneath said ram, said magazine having an axis parallel to but offset from the axis of the ram and an outer wall defining a radially outer periphery of said magazine, said magazine comprising a base and cover, the former being mounted on said tool, said base and cover cooperating to form a circular track having an open feed end, and a spring loaded handle projecting radially beyond said magazine, said handle including a pusher operative to urge a collation of said fasteners along said track toward said position beneath said ram, and a spring assembly in the center of said magazine, said handle extending from said spring assembly radially over the top of said cover and having manually engageable gripping means extending radially outwardly of said outer wall.

17. A tool as set forth in claim 16 wherein said handle includes a pusher arm adapted to be inserted into the open feed end of said track.

18. A tool as set forth in claim 16 including means to position said pusher out of the way of the entry to said track so that a new collation may be positioned therein.

19. A tool as set forth in claim 16 wherein the track of said magazine comprises an interior shelf, said pusher including an inwardly directed tab adapted to ride on said shelf.

20. A tool as set forth in claim 19 wherein said track is formed by the top wall and outer skirt of the cover, and a wall and outwardly directed shelf of the base.

21. A tool as set forth in claim 19 wherein said handle extends radially over the top of the cover, then downwardly along said outer skirt, then inwardly beneath said skirt, and then upwardly, said pusher extending circularly from the upper end of said last mentioned portion of the handle.

* * * * *